United States Patent [19]

Knapp

[11] Patent Number: 4,549,882

[45] Date of Patent: Oct. 29, 1985

[54] CORROSION INHIBITORS FOR ALCOHOL CONTAINING FUELS

[75] Inventor: Gordon G. Knapp, Baton Rouge, La.

[73] Assignee: Ethyl Corporation, Richmond, Va.

[21] Appl. No.: 662,777

[22] Filed: Oct. 19, 1984

[51] Int. Cl.[4] ..... C10L 1/22

[52] U.S. Cl. ..... 44/53; 44/56; 44/63; 44/72; 252/392

[58] Field of Search ..... 44/53, 56, 63, 72; 252/392

[56] References Cited

U.S. PATENT DOCUMENTS 2,564,758 12/1984 Haggard ..... 252/392

4,253,876 3/1981 Godar et al. ..... 252/392

4,431,430 2/1984 Sung ..... 44/53

4,440,545 4/1984 Weidig ..... 44/56

*Primary Examiner*—Y. Harris-Smith

*Attorney, Agent, or Firm*—Donald L. Johnson; John F. Sieberth; W. G. Montgomery

[57] ABSTRACT

Corrosion caused by gasohol or alcohol motor fuels is inhibited by the addition of a corrosion inhibiting amount of the combination of (A) at least one monoalkenylsuccinic acid wherein the alkenyl group contains about 8 to 30 carbon atoms and (B) an N-(2-hydroxyalkyl)monoalkanolamine or an N-(2-hydroxyalkyl)dialkanolamine.

22 Claims, No Drawings

CORROSION INHIBITORS FOR ALCOHOL CONTAINING FUELS

BACKGROUND

In the past metal corrosion caused by conventional motor fuels such as gasoline was not much of a problem because such hydrocarbon fuels are inherently non-corrosive. However, with the advent of fuels containing alcohols such as gasohol or straight alcohol fuels, corrosion has become a major problem because such fuels are corrosive. It has been reported that this corrosion is due to the presence of acidic contaminants in the fuels such as formic acid. It is almost impossible to avoid such contaminants because they occur in fuel grade alcohols and are also formed in storage as normal alcohol oxidation products.

It is known from U.S. Pat. No. 2,993,772 that alkenyl succinic acids as well as their anhydrides inhibit and/or prevent the deposit-forming tendency of hydrocarbon fuels during combustion and/or modify the deleterious effect of the formed deposits in both leaded and unleaded fuels, particularly in gasoline and jet fuels. The reaction products of long chain alkylene oxides and alkanolamines also are known. For example, Japanese Pat. No. Sho 48[1973]-88135 discloses such products and their use as antistatic agents in ABS resins. It has now been discovered that the combination of monoalkenylsuccinic acids in which the alkenyl group contains about 8 to 30 carbon atoms with certain N-(2-hydroxyalkyl)monoalkanolamines and N-(2-hydroxyalkyl)-dialkanolamines provides corrosion inhibiting properties to fuels containing alcohol such as gasohol and straight alcohol fuels.

SUMMARY

According to the present invention metal corrosion caused by alcohol-type motor fuels is inhibited by adding to the fuel the combination of (A) at least one monoalkenylsuccinic acid wherein the alkenyl group contains about 8 to 30 carbon atoms and (B) an N-(2-hydroxyalkyl)monoalkanolamine or an N-(2-hydroxyalkyl)dialkanolamine.

THE INVENTION

The invention provides a liquid fuel adapted for use in an internal combustion engine said fuel comprising from 5 to 100 weight percent of one or more alcohols, from 0 to 95 weight percent gasoline and a corrosion inhibiting amount of the combination of (A) at least one monoalkenylsuccinic acid wherein the alkenyl group contains about 8 to 30 carbon atoms and (B) an N-(2-hydroxyalkyl)monoalkanolamine or an N-(2-hydroxyalkyl)dialkanolamine.

The additive combination of this invention can be beneficial in any engine fuel containing or consisting of an oxygenate. Such fuels include gasoline-alcohol mixtures referred to as "gasohol" as well as straight alcohol fuels. Useful alcohols are methanol, ethanol, n-propanol, isopropanol, 1-butanol, 2-butanol, t-butanol, 2-methyl-2-propanol, isobutanol, mixtures thereof, such as methanol and t-butanol and the like. Gasohols usually contain about 2 to 30 volume percent alcohol. At concentrations above 10 volume percent phase separation problems are encountered especially in the presence of water.

Phase separation can be minimized by including co-solvents in the gasohol such as ethers, ketones, esters and the like. An especially useful co-solvent is methyl tert-butyl ether which also serves to increase octane value.

The additive combination may be used at a concentration which provides the required amount of corrosion protection. A useful range is about 1 to 5000 pounds per thousand barrels (ptb). A more preferred range is about 5 to 2000 ptb and the most preferred concentration is 5 to 500 ptb.

The monoalkenylsuccinic acids additives of the present invention (Component A) are well known in the art. These acids are readily prepared by the condensation of an olefin with maleic anhydride followed by hydrolysis (see U.S. Pat. No. 2,133,734 and U.S. Pat. No. 2,741,597). Suitable monoalkenylsuccinic acids include octenylsuccinic acid, decenylsuccinic acid, undecenylsuccinic acid, dodecenylsuccinic acid, pentadecenylsuccinic acid, octadecenylsuccinic acid and isomers thereof having alkenyl groups of various hydrocarbon structures. The preferred monoalkenylsuccinic acid is dodecenylsuccinic acid, more preferably, dodecenylsuccinic acid prepared from propylene tetramer.

While an alkenyl group ranging from 8 to 30 carbon atoms is preferred as indicated above, it is contemplated that substantially any alkenylsuccinic acid or its equivalent anhydride may be employed in the fuels of the present invention provided it is sufficiently soluble in the fuel to be effective in combination with the alkanolamine co-additives of the invention as a corrosion inhibitor. Further, since relatively pure olefins are difficult to obtain and are often too expensive for commercial use, alkenylsuccinic acids prepared as mixtures by reacting mixed olefins with maleic anhydride may be employed in this invention as well as relatively pure alkenyl succinic acids. Mixed alkenylsuccinic acids in which the alkenyl group averages 6–8, 8–10 and 10–12 carbon atoms are commercially available.

Component B of the combination is either an N-(2-hydroxyalkyl)monoalkanolamine or an N-(2-hydroxyalkyl)dialkanolamine. These compounds can be obtained easily by a ring opening reaction of a long chain alkeylene oxide and an alkanolamine. The method can be illustrated by the following reaction equation:

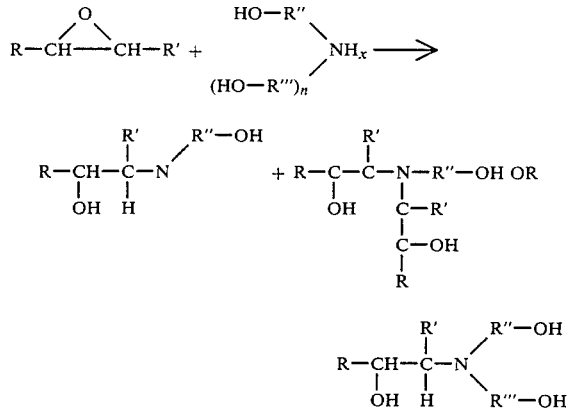

wherein R is a saturated aliphatic hydrocarbon group having from 8 to 22 carbon atoms, R′ is hydrogen or a saturated aliphatic hydrocarbon group having from 1 to 6 carbon atoms, and R″ and R‴ are saturated aliphatic hydrocarbon radicals having from 1 to 6 carbon atoms, n equals o to 1, x equals 1 to 2, x equals 1 when n equals 1, and x equals 2 when n equals o. The products of the reaction by the above method of manufacture are equimolar reaction products of both olefin oxide and alkanolamine. The method is proposed in Japanese Patent No. Sho 42[1967]-10729. As taught therein, one mole of the olefin oxide represented by the above formula and 1 mole of alkanolamine are reacted in an inert gas at a temperature of from 130° C. to 200° C.

Thus, in a more preferred embodiment of the present invention there is provided a liquid fuel adapted for use in an internal combustion engine said fuel comprising from 5 to 100 weight percent of one or more alcohols, from 0 to 95 weight percent gasoline and a corrosion inhibiting amount of the combination of (A) at least one monoalkenylsuccinic acid wherein the alkenyl group contains about 8 to 30 carbon atoms and (B) an N-(2-hydroxyalkyl)monoalkanolamine having the structure:

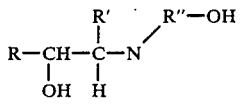

or an N-(2-hydroxyalkyl)dialkanolamine having the structure:

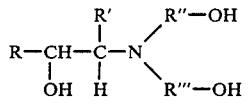

wherein R is a saturated aliphatic hydrocarbon group having from 8 to 22 carbon atoms, R′ is hydrogen or a saturated aliphatic hydrocarbon group having from 1 to 6 carbon atoms, and R″ and R‴ are saturated aliphatic hydrocarbon radicals having from 1 to 6 carbon atoms. Examples of specific compounds include N-(2-hydroxyoctyl)ethanolamine, N-(2-hydroxyoctyl)diethanolamine, N-(2-hydroxyoctyl)isopropylamine, N-(2-hydroxyoctyl)diisopropylamine, N-(2-hydroxyoctyl)-butanolamine, N-(2-hydroxyoctyl)isobutanolamine, N-(2-hydroxyoctyl)dibutanolamine, N-(2-hydroxydecyl-)ethanolamine, N-(2-hydroxydecyl)diethanolamine, N-(2-hydroxydecyl)isopropylamine, N-(2-hydroxydecyl)-diisopropylamine, N-(2-hydroxydecyl)butanolamine, N-(2-hydroxydecyl)isobutanolamine, N-(2-hydroxydecyl)dibutanolamine, N-(2-hydroxydodecyl)ethanolamine, N-(2-hydroxydodecyl)diethanolamine, N-(2-hydroxydodecyl)isopropylamine, N-(2-hydroxydodecyl)diisopropylamine, N-(2-hydroxydodecyl)-butanolamine, N-(2-hydroxydodecyl)isobutanolamine, N-(2-hydroxydodecyl)dibutanolamine, N-(2-hydroxyhexadecyl)ethanolamine, N-(2-hydroxyhexadecyl)diethanolamine, N-(2-hydroxyhexadecyl)isopropylamine, N-(2-hydroxyhexadecyl)diisopropylamine, N-(2-hydroxyhexadecyl)butanolamine, N-(2-hydroxyhexadecyl)isobutanolamine, N-(2-hydroxyhexadecyl)-dibutanolamine, N-(2-hydroxyoctadecyl)ethanolamine, N-(2-hydroxyoctadecyl)diethanolamine, N-(2-hydroxyoctadecyl)isopropylamine, N-(2-hydroxyoctadecyl)-diisopropylamine, N-(2-hydroxyoctadecyl)butanolamine, N-(2-hydroxyoctadecyl)isobutanolamine, N-(2-hydroxyoctadecyl)dibutanolamine, and the like. Especially preferred compounds are N-(2-hydroxydodecyl-)ethanolamine and N-(2-hydroxydodecyl)diethanolamine.

The weight ratio of component A to component B in the combination can vary over a wide range such as 5 to 95 parts A to 5 to 95 parts B, preferably 1 to 10 parts A to 1 to 10 parts B. In a more preferred embodiment the weight ratio is about 0.5–5 parts component A for each part component B. In a still more preferred embodiment there are 0.6–4.0 parts component A per each part component B. The most preferred ratio is 1:1.

Components A and B can be separately added to the fuel. More preferably components A and B are premixed to form a package and this package is added to the fuel in an amount sufficient to provide the required degree of corrosion protection. In other words, part of the present invention are corrosion inhibiting fluids which comprise (A) at least one monoalkenylsuccinic acid in which the alkenyl group contains about 8 to 30 carbon atoms, and (B) an N-(2-hydroxyalkyl)monoalkanolamine or an N-(2-hydroxyalkyl)dialkanolamine.

Use of such fluids in addition to resulting in great convenience in storage, handling, transportation, blending with fuels, and so forth, also are potent concentrates which serve the function of inhibiting or minimizing corrosion caused by alcohol containing fuels.

Most preferably components A and B are pre-mixed with a solvent to make handling and blending easier. Suitable solvents include alcohols (e.g., methanol, ethanol, isopropanol), ketones (acetone, methyl ethyl ketone), esters (tert-butyl acetate) and ethers (e.g., methyl tert-butyl ether).

Aromatic hydrocarbons are very useful solvents. These include benzene, toluene, xylene and the like. Excellent results can be obtained using xylene.

The concentration of the active components A and B in the package can vary widely. For example the active content can range from about 5 weight percent up to the solubility limit of A or B in the solvent. With xylene a total active content of about 5–60 weight percent is generally used, especially about 50 weight percent.

The additive fluids as well as the fuel compositions of the present invention, may also contain other additives, such as antioxidants, metal deactivators, detergents, cold flow improvers, and the like.

Tests were conducted to measure the anti-corrosion properties of the additive combination. In the tests, the corrosion of steel cylinder rods ($\frac{1}{8}$ in. $\times$ 3 in.) semisubmersed in test fluid was measured under different test conditions. The rods were first cleaned with carborundum 180, polished with crocus cloth, washed with acetone and then dried at room temperature.

Each rod was weighed and then semisubmersed in 10 milliliters of the test fluid in a sealed bottle for the specified time at the specified temperature.

At the end of the test period, the rods were removed from the fuel, and, after loose deposits were removed with a light brush, the rods were washed and dried as at the start of the test and then reweighed. Any change in rod weight was recorded. Loss of weight indicated corrosion.

A series of three tests were carried out lasting 7 days, 14 days and 30 days, respectively. The series of tests were conducted in fuels comprising 5 volume percent methanol and 5 volume percent t-butanol in gasoline (indolene) containing 0.5 weight percent of 5.0 percent acetic acid in water. The tests were conducted at 25° C.

The test additives added to the test fuels were equal weight mixtures (100 ptb) of either dodecenylsuccinic acid prepared from dodecene or propylene tetramer in combination with either N-(2-hydroxydodecyl)e-thanolamine or N-(2-hydroxydodecyl)diethanolamine and 50 ptb of each individual component.

The results of these tests which are set out in the table below demonstrate the excellent anticorrosion properties of a fuel containing an additive combination of the invention.

TABLE

| Additives | Weight reduction (mg.) |
|---|---|
| 7-DAY TESTS | |
| none | 7.5 |
| N—(2-hydroxydodecyl)ethanolamine | 8.5 |
| N—(2-hydroxydodecyl)diethanolamine | 6.5 |
| dodecenylsuccinic acid from dodecene | 5.7 |
| dodecenylsuccinic acid from propylene tetramer | 3.8 |
| N—(2-hydroxydodecyl)ethanolamine + dodecylsuccinic acid from dodecene | 0.1 |
| N—(2-hydroxydodecyl)ethanolamine + dodecenylsuccinic acid from propylene tetramer | 0.4 |
| N—(2-hydroxydodecyl)diethanolamine + dodecenylsuccinic acid from dodecene | 0.4 |
| 14-DAY TESTS | |
| none | 10.3 |
| N—(2-hydroxydodecyl)ethanolamine | 11.1 |
| N—(2-hydroxydodecyl)diethanolamine | 9.1 |
| dodecenylsuccinic acid from dodecene | 10.5 |
| dodecenylsuccinic acid from propylene tetramer | 8.9 |
| N—(2-hydroxydodecyl)ethanolamine + dodecylsuccinic acid from dodecene | 0.4 |
| N—(2-hydroxydodecyl)ethanolamine + dodecenylsuccinic acid from propylene tetramer | 0.6 |
| N—(2-hydroxydodecyl)diethanolamine + dodecenylsuccinic acid from dodecene | 0.9 |
| 30-DAY TESTS | |
| none | 12.1 |
| N—(2-hydroxydodecyl)ethanolamine | 11.5 |
| N—(2-hydroxydodecyl)diethanolamine | 12.4 |
| dodecenylsuccinic acid from dodecene | 15.1 |
| dodecenylsuccinic acid from propylene tetramer | 15.1 |
| N—(2-hydroxydodecyl)ethanolamine + dodecylsuccinic acid from dodecene | 1.1 |
| N—(2-hydroxydodecyl)ethanolamine + dodecenylsuccinic acid from propylene tetramer | 0.4 |
| N—(2-hydroxydodecyl)diethanolamine + dodecenylsuccinic acid from dodecene | 1.1 |

I claim:

1. A liquid fuel adapted for use in an internal combustion engine said fuel comprising from 5 to 100 weight percent of one or more alcohols, from 0 to 95 weight percent gasoline and a corrosion inhibiting amount of the combination of (A) at least one monoalkenylsuccinic acid wherein the alkenyl group contains about 8 to 30 carbon atoms, and (B) an N-(2-hydroxyalkyl)-monoalkanolamine or an N-(2-hydroxyalkyl)dialkanolamine.

2. A liquid fuel adapted for use in an internal combustion engine, said fuel comprising from 5 to 100 weight percent of one or more alcohols, 0 to 95 weight percent gasoline and a corrosion inhibiting amount of the combination of (A) at least one monoalkenylsuccinic acid wherein the alkenyl group contains about 8 to 30 carbon atoms, and (B) an N-(2-hydroxyalkyl)monoalkanolamine having the structure:

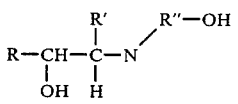

or an N-(2-hydroxyalkyl)dialkanolamine having the structure:

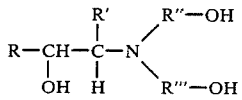

wherein R is a saturated aliphatic hydrocarbon group having from 8 to 22 carbon atoms, R′ is hydrogen or a saturated aliphatic hydrocarbon group having from 1 to 6 carbon atoms, and R″ and R‴ are saturated aliphatic hydrocarbon radicals having from 1 to 6 carbon atoms.

3. A liquid fuel of claim 2 wherein said monoalkenylsuccinic acid is dodecylsuccinic acid.

4. A liquid fuel of claim 2 wherein said N-(2-hydroxyalkyl)monoalkanolamine is N-(2-hydroxydodecyl)ethanolamine.

5. A liquid fuel of claim 2 wherein said N-(2-hydroxyalkyl)dialkanolamine is N-(2-hydroxydodecyl)diethanolamine.

6. A liquid fuel adapted for use in an internal combustion engine, said fuel comprising from 2 to 30 weight percent of one or more alcohols, 70 to 98 weight percent gasoline and a corrosion inhibiting amount of the combination of (A) at least one monoalkenylsuccinic acid wherein the alkenyl group contains about 8 to 30 carbon atoms, and (B) an N-(2-hydroxyalkyl)monoalkanolamine or N-(2-hydroxyalkyl)dialkanolamine.

7. A liquid fuel adapted for use in an internal combustion engine, said fuel comprising from 2 to 30 weight percent of one or more alcohols, 70 to 98 weight percent gasoline and a corrosion inhibiting amount of the combination of (A) at least one monoalkenylsuccinic acid wherein the alkenyl group contains about 8 to 30 carbon atoms, and (B) an N-(2-hydroxyalkyl)monoalkanolamine having the structure:

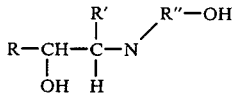

or an N-(2-hydroxyalkyl)dialkanolamine having the structure:

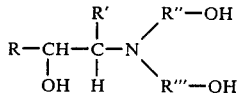

wherein R is a saturated aliphatic hydrocarbon group having from 8 to 22 carbon atoms, R′ is hydrogen or a saturated aliphatic hydrocarbon group having from 1 to 6 carbon atoms, and R″ and R‴ are saturated aliphatic hydrocarbon radicals having from 1 to 6 carbon atoms.

8. A liquid fuel of claim 7 wherein said monoalkenylsuccinic acid is dodecylsuccinic acid.

9. A liquid fuel of claim 7 wherein said N-(2-hydroxyalkyl)monoalkanolamine is N-(2-hydroxydodecyl)ethanolamine.

10. A liquid fuel of claim 7 wherein said N-(2-hydroxyalkyl)dialkanolamine is N-(2-hydroxydodecyl)diethanolamine.

11. A corrosion inhibiting concentrate containing at least the combination of (A) at least one monoalkenylsuccinic acid wherein the alkenyl group contains about 8 to 30 carbon atoms, and (B) an N-(2-hydroxyalkyl)- monoalkanolamine or an N-(2-hydroxyalkyl)dialkanolamine.

12. A corrosion inhibiting concentrate containing at least the combination of (A) at least one monoalkenylsuccinic acid wherein the alkenyl group contains 8 to 30 carbon atoms, and (B) an N-(2-hydroxyalkyl)monoalkanolamine having the structure:

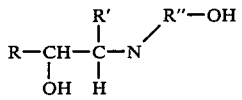

or an N-(2-hydroxyalkyl)dialkanolamine having the structure:

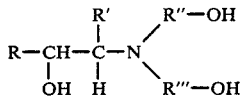

wherein R is a saturated aliphatic hydrocarbon group having from 8 to 22 carbon atoms, R′ is hydrogen or a saturated aliphatic hydrocarbon group having from 1 to 6 carbon atoms, and R″ and R‴ are saturated aliphatic hydrocarbon radicals having from 1 to 6 carbon atoms.

13. A concentrate of claim 12 wherein said monoalkenylsuccinic acid is dodecylsuccinic acid.

14. A concentrate of claim 12 wherein said N-(2-hydroxyalkyl)monoalkanolamine is N-(2-hydroxydodecyl)ethanolamine.

15. A concentrate of claim 12 wherein said N-(2-hydroxyalkyl)dialkanolamine is N-(2-hydroxydodecyl)-diethanolamine.

16. A concentrate of claim 12 comprising from about 5 to 95 parts of said monoalkenylsuccinic acid and from about 5 to 95 parts N-(2-hydroxyalkyl)monoalkanolamine or N-(2-hydroxyalkyl)dialkanolamine.

17. A corrosion inhibiting concentrate comprising a solvent containing 5 to 60 weight percent of the combination of (A) at least one monoalkenylsuccinic acid in which the alkenyl group contains about 8 to 30 carbon atoms, and (B) an N-(2-hydroxyalkyl)monoalkanolamine or an N-(2-hydroxyalkyl)dialkanolamine.

18. A corrosion inhibiting concentrate comprising a solvent containing 5 to 60 weight percent of the combination of (A) at least one monoalkenylsuccinic acid wherein the alkenyl group contains about 8 to 30 carbon atoms, and (B) an N-(2-hydroxyalkyl)monoalkanolamine having the structure:

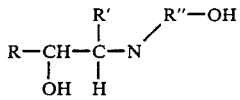

or an N-(2-hydroxyalkyl)dialkanolamine having the structure:

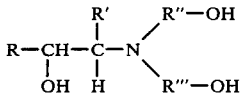

wherein R is a saturated aliphatic hydrocarbon group having from 8 to 22 carbon atoms, R′ is hydrogen or a saturated aliphatic hydrocarbon group having from 1 to 6 carbon atoms, and R″ and R‴ are saturated aliphatic hydrocarbon radicals having from 1 to 6 carbon atoms.

19. A concentrate of claim 18 wherein said monoalkenylsuccinic acid is dodecylsuccinic acid.

20. A concentrate of claim 18 wherein said N-(2-hydroxyalkyl)monoalkanolamine is N-(2-hydroxydodecyl)ethanolamine.

21. A concentrate of claim 18 wherein said N-(2-hydroxyalkyl)dialkanolamine is N-(2-hydroxydodecyl)-diethanolamine.

22. A concentrate of claim 18 wherein said solvent is xylene.

* * * * *